United States Patent [19]

Yuhas et al.

[11] Patent Number: 4,934,438

[45] Date of Patent: Jun. 19, 1990

[54] MOTORIZED WINDOW BLIND WITH MANUAL OVERRRIDE

[75] Inventors: Ralph G. Yuhas; William H. Birmingham, both of Helena, Mont.

[73] Assignee: Rolscreen Company, Pella, Iowa

[21] Appl. No.: 208,723

[22] Filed: Jun. 20, 1988

[51] Int. Cl.[5] ..... E06B 9/30

[52] U.S. Cl. ..... 160/107; 160/177; 160/178.1; 49/82; 49/92; 49/139; 174/52.1

[58] Field of Search ..... 160/176.1, 168.1, 177, 160/107, 331, 310, 178.1; 49/82, 92, 139, 140; 174/52.1, 50; 248/219.4; 220/83, 18, 3.3, 3.5

[56] References Cited

U.S. PATENT DOCUMENTS

| | | | |
|---|---|---|---|
| 2,675,227 | 4/1954 | Baird et al. | 49/82 X |
| 2,675,228 | 4/1954 | Baird et al. | 49/140 X |
| 2,758,834 | 8/1956 | Sanford et al. | 49/140 X |
| 3,068,971 | 12/1962 | Ringler | 49/139 X |
| 3,096,078 | 7/1963 | Steingass et al. | 160/331 X |
| 3,375,322 | 3/1968 | Serio et al. | 174/52.1 |
| 3,389,737 | 6/1968 | Arnold et al. | 160/107 |
| 3,722,572 | 3/1973 | Hall | 160/176.1 X |
| 4,096,903 | 6/1978 | Ringle, III | 160/176 |
| 4,274,469 | 7/1981 | Kuyper et al. | 160/107 |
| 4,643,238 | 2/1987 | Tachikawa et al. | 160/168.1 |
| 4,719,955 | 1/1988 | Tachikawa et al. | 160/168.1 |
| 4,850,416 | 7/1989 | Evers | 160/177 X |

FOREIGN PATENT DOCUMENTS

| | | | |
|---|---|---|---|
| 995224 | 6/1965 | United Kingdom | 160/107 |

*Primary Examiner*—David M. Purol

*Attorney, Agent, or Firm*—Zarley, McKee, Thomte, Voorhees & Sease

[57] ABSTRACT

A motorized window blind operator is slidably received in a mounting bracket in the plane of the blind in a window frame. A motor in the operator housing normally opens and closes the blind but can be overridden by a manually operated gear train utilizing a screw driver extending through a hole in the inner window pane into engagement with a slotted hub on a gear in the housing. An upstanding flange on the housing overlaps with the adjacent blind slat to prevent light passing therethrough when the blind is closed. The housing has a V-shaped vertical end which receives the ends of the blind slats which have a similar shape for preventing light passage therebetween.

12 Claims, 3 Drawing Sheets

80
86
82
84
18
10
68
64
62
60
66
45
56
58
72
76
12
79
52
54
71
78
70

MOTORIZED WINDOW BLIND WITH MANUAL OVERRRIDE

BACKGROUND OF THE INVENTION

The Slimshade between the pane window blind sold by Rolscreen Company, Pella, Iowa, utilizes manual operators as seen in U.S. Pat. Nos. 3,389,737, dated June 25, 1968, and 4,274,479, dated June 23, 1981. A window blind has been motorized as seen in U.S. Pat. No. 4,096,903, June 27, 1978 wherein a power driven support shaft for the blind slats is positioned in the top window frame for opening and closing the slats.

What is needed is a self contained motorized unit with manual override which can be positioned in the plane of the blind between the window panes and be easily installed removed as desired.

SUMMARY OF THE INVENTION

The motorized window blind of this invention involves a housing containing a motorized gear train and a manual gear train operating an output shaft connected to a slat of the blind. A screw driver can be inserted through a small opening in a window pane into engagement with a slotted manually operated gear in the housing for operating the output shaft should this be necessary in case of a power outage. The two gear trains include common gears which include a worm gear which is axially driven and is connected to a helical gear in turn connected to the output shaft. The output shaft cannot be turned by applying rotational forces directly to it as the worm prevents its rotation.

The top of the motorized housing includes a flange which overlaps the adjacent blind slat and prevents light from passing between the housing and the blind slats. A V-shaped vertical side of the housing cooperates with the adjacent slat ends having a complementary shape to also prevent light from passing between the housing and the ends of the blind slats when the blind is closed.

A mounting bracket is provided which has positioning stop flanges on it for positive centering when mounting in the window frame. The housing and the bracket include cooperating ribs and grooves allowing the housing to be slidably positioned in the frame. A cap including the upstanding flange slidably engages the top of the housing. The exterior surface of the bracket is sloped to complement the slope of the window frame such that the housing can be positioned in the plane of the blind.

DESCRIPTION OF THE PREFERRED EMBODIMENT

Figure 1:
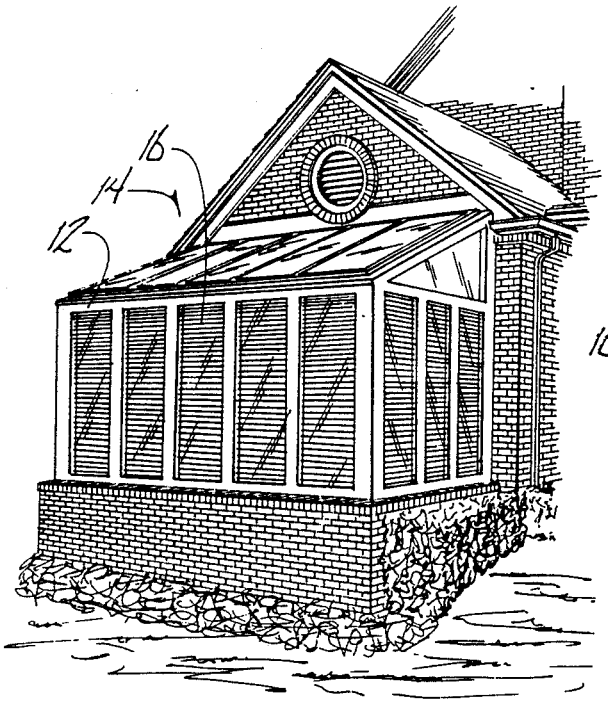
FIG. 1 is a perspective view of a house having venetian blinds utilizing the motorized window blind with manual override of this invention.
Figure 2:
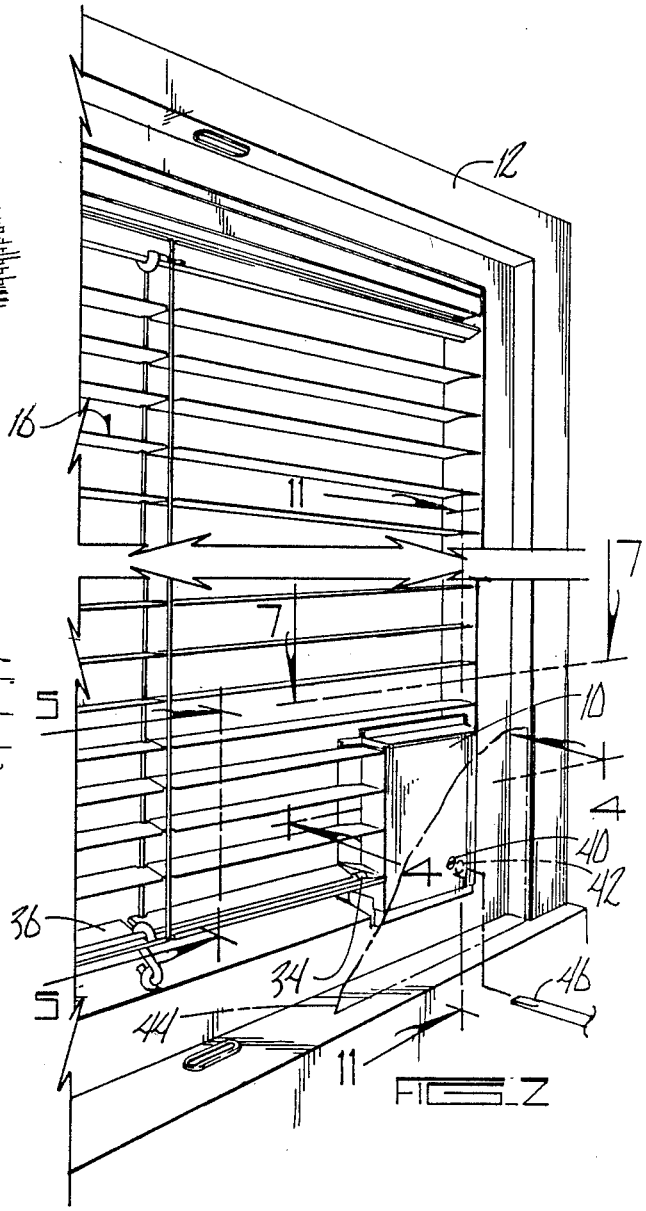
FIG. 2 is a fragmentary, enlarged perspective view of a motorized blind.
Figure 3:
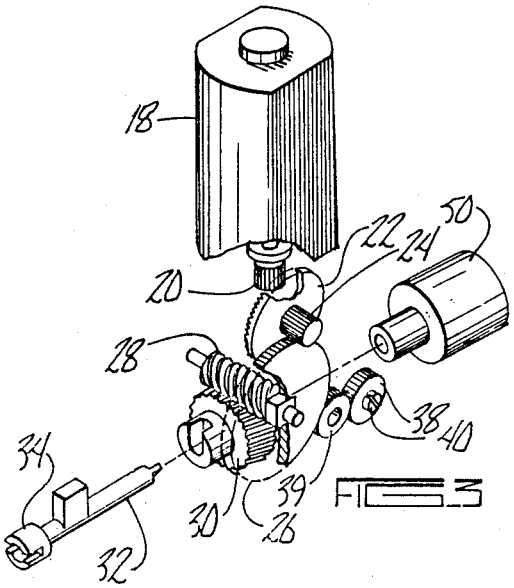
FIG. 3 is an exploded perspective view of the motor and gear components in the housing.
Figure 4:
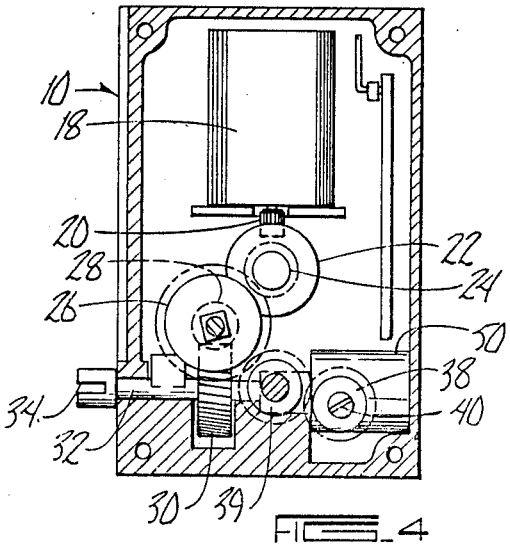
FIG. 4 is a cross-sectional view taken along line 4—4 of FIG. 2.
Figure 5:
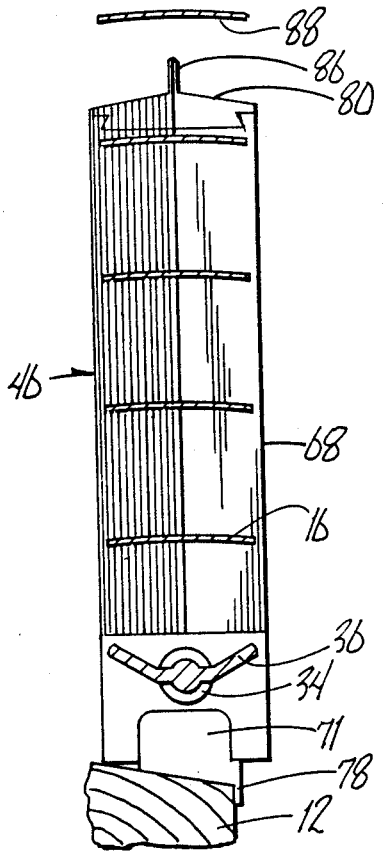
FIG. 5 is a cross-sectional view taken alone line 5—5 in FIG. 2 showing the blind in an open position.

The motorized window blind operator of this invention is referred to in FIGS. 2 and 4, generally by the reference numeral 10. The operator 10 is mounted in a window frame 12 in a house 14 and operates slatted blinds 16. Operator 10 includes a motor 18 which is connected through a series of gears 20, 22, 24, and 26 axially to a worm gear 28 which in turn drives a helical gear 30 which axially telescopically engages an output drive shaft 32. A slot 34 is provided in the output drive shaft 32 and engages the adjacent end of slat 36 of the blind 16. A manual override gear train is also provided in the housing of the operator 10 and includes a pair of gears 38 and 39 with gear 39 engaging gear 26. A slotted axial hub 40 is provided on the gear 38 and is aligned with an opening 42 in a window pane 44 such that a screw driver 46 may be inserted through the opening 42 to manually operate the gear 38 and thus override the motor 18 and open and close the blind 16 through operation of the output shaft 34. It is seen that while the worm gear 28 may be axially driven by the gear 26 and operate the output shaft 34, the reverse is not possible. Rotational forces applied to the output shaft 34 will not cause rotation since the worm gear 28 cannot be rotated by the helical gear 30. The slotted hub 40 is totally confined within the operator housing. The inner end of the output drive shaft 32 is also connected to a potentiometer 50 which is part of an electrical control circuit not shown.

Figures 9, 10, 11, 12:
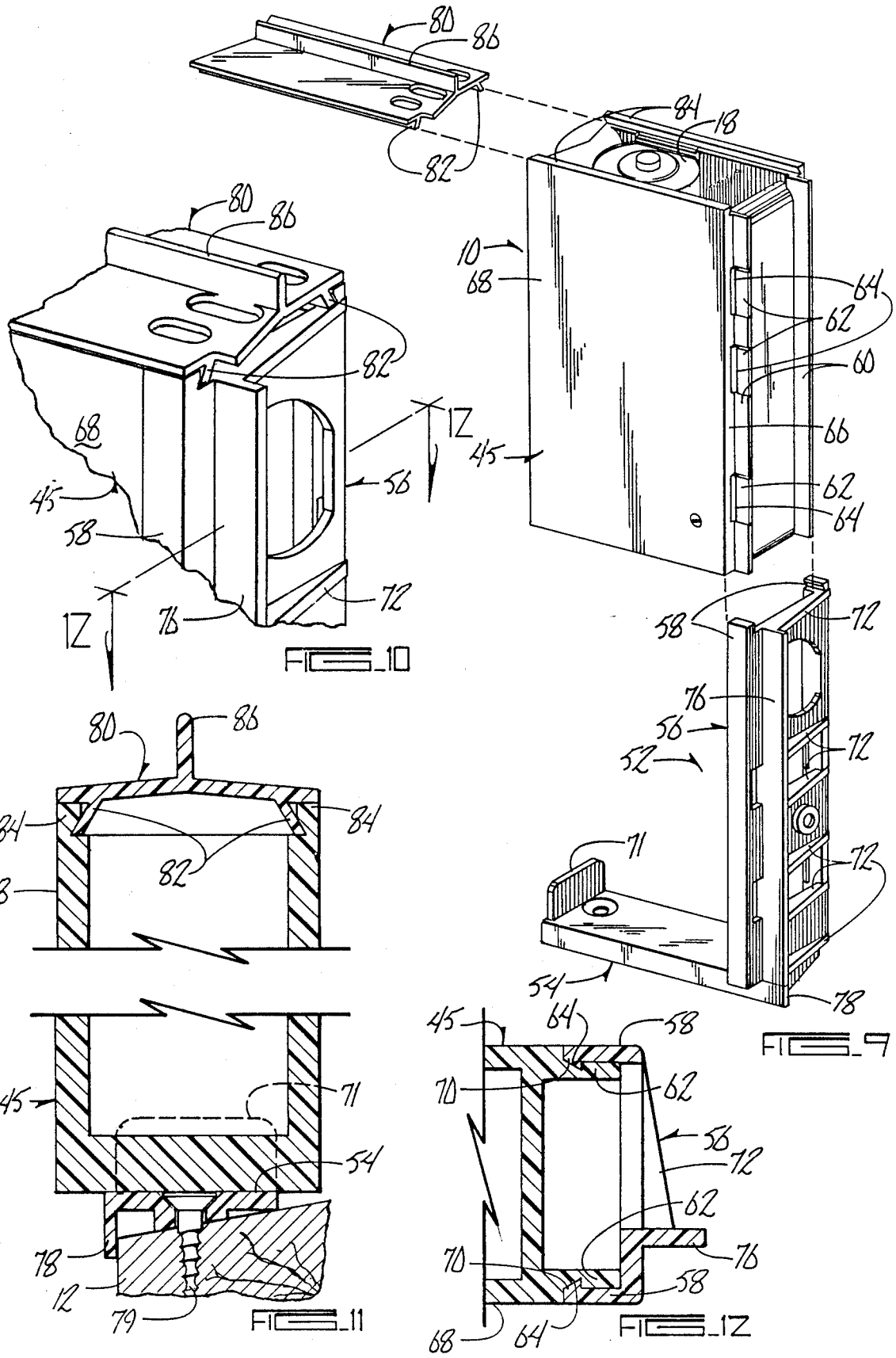
FIG. 9 is an exploded perspective view of the motor housing, mounting bracket and cap.
FIG. 10 is a fragmentary perspective view of the motor housing, bracket, and cap assembly.
FIG. 11 is a cross-sectional view taken along line 11—11 in FIG. 2.
FIG. 12 is a cross-sectional vieww taken along line 12—12 in FIG. 10.

The motorized operator 10 has a housing 45 which is secured in the window frame 12 by the mounting bracket 52 as seen in FIG. 9–12. The mounting bracket 52 includes a base member 54 interconnected to a vertical member 56. The vertical member 56 has inwardly extending parallel legs 58 slidably engaging ribs 60 outwardly extending on the housing 45. Shoulders 62 are provided on the outer surfaces of the ribs 60 and cooperate to define grooves 64 between the shoulders 62 and the end edge 66 of a front wall 68 of the housing 45. As seen in FIG. 12, shoulders 70 on the inside faces of the legs 58 are received in the grooves 64 to interlock the housing 45 to the bracket 52. An upstanding tab 71 on the outer end of base member 54 engages the inner vertical wall of the housing 45 as seen in FIG. 11.

Figure 7:
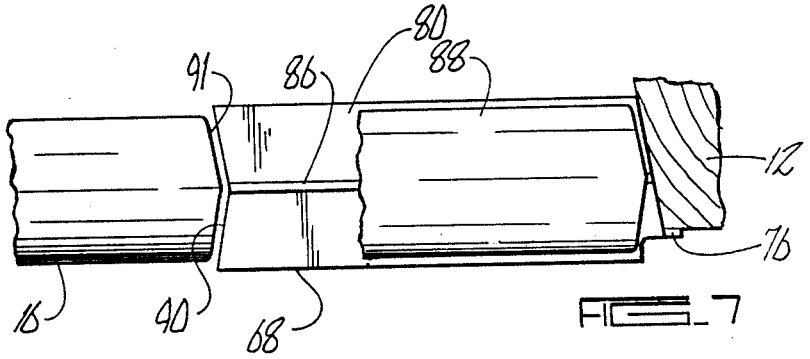
FIG. 7 is a cross-sectional view taken along line 7—7 in FIG. 2 showing the blind in an open position.
Figure 8:
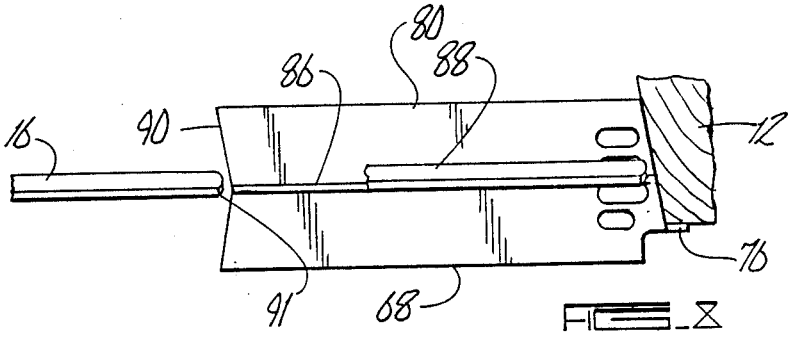
FIG. 8 is a cross-sectional view similar to FIG. 7 but showing the blind in a closed position.

The vertical member 56 has an outer surface comprised of a series of gussets 72 sloped to correspond to the slope of the window frame 12 as seen in FIGS. 7 and 8, thus allowing the housing 12 to be positioned squarely in the plane of the blind 16. As seen in FIG. 11, the base 54 has a similar sloped bottom surface to complement the sloped window frame 12.

The vertical member 56 is also provided with an outwardly extending stop flange 76 and the base member 54 includes a similar downwardly extending stop flange 78 for positively centering and positioning the bracket 52 and housing 12 in the window frame 12. It is seen that the stop flanges 76 and 78 engage the outer face of the window frame 12 in FIGS. 6–8 and 11. The bracket 52 is secured to the window frame 12 by screws 79.

Figure 6:
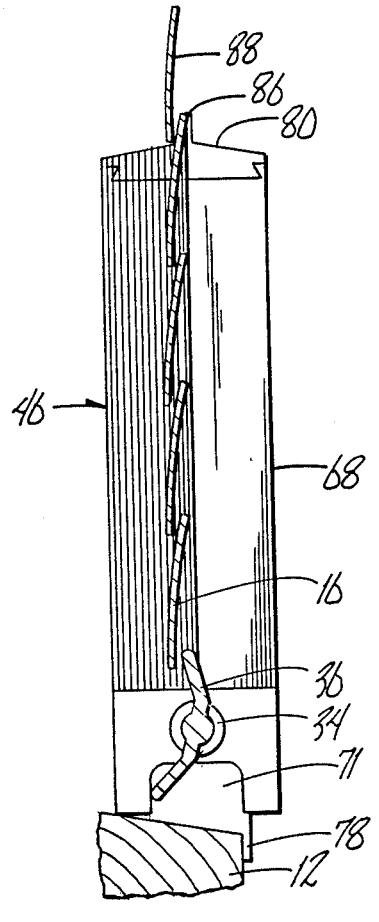
FIG. 6 is a view similar to FIG. 5, but showing the blind in a closed position.

A cap 80 slidably engages the top of the housing and includes downwardly outwardly flared ribs 82 matingly engaging the inner surfaces of the upstanding ribs 84. An upstanding flange 86 is provided on the center line of the cap and overlaps the slat 88 as seen in FIG. 6 when the blind is in its closed position, thereby preventing light from passing between the housing 45 and the slat 88. The slat 88 may be turned to be positioned on either side of flange 86.

As seen in FIGS. 7 and 8, the housing has an inside vertical end surface 90 which is V-shaped such that when the blinds 16 are closed as seen in FIG. 8, light does not have a straight line to pass between the housing and the ends of the blinds. Adjacent ends 91 of the blinds are also complementarily V-shaped to be closely positioned to the housing as seen in FIG. 7 when the slats are in their horizontal open position. The end of the cap 80 is also V-shaped to correspond to the end wall 90 of the housing.

It is thus seen in operation that a motorized operator with manual override can be installed in a window frame quickly by frist installing the mounting bracket 52 by screws 79. The stops 76 and 78 accurately position the bracket in place and the housing is slid into the bracket vertically with the blinds then being put in position and the bottom slat 36 having its outer end inserted into the slotted end 34 of the output drive shaft 32. No light will pass between the blinds and the housing due to the overlap of the flange 86 and the slat 88 and the V-shaped end 90 of the housing which cooperates with a similar shape on the ends 91 of the slats 16. A control circuit not shown operates the motor 18 to drive the output shaft 34 under normal conditions, but should there be a power outage, or it is otherwise desirable to manually operate the blinds, this can be accomplished readily by insertion of the screw driver 46 through the hole 42 in the inside window pane 44 for engagement witth the slotted hub 40 in the gear 38. Thus, the output drive shaft 32 may be operated through either of the two power trains connecting the manually driven gear 38 or the motor gear 20 to the output shaft 34 through common gears 26, 28 and 30.

What is claimed is:

1. A widow and window blind comprising:

a window frame having top and bottom and opposite side frame portions forming a plurality of corners in a plane, an operator having a housing positioned in the plane of and in one of the corners of said frame, a slatted blind in said frame having slats adjustable between open and closed positions, said housing having front and back sides, top and bottom ends, and opposite vertical sides, and one of said slats being adjacent said top end of said housing, said top end of said housing having an upstanding flange disposed between the opposite vertical sides and being generally perpendicular thereto for overlaying the adjacent slat of a blind in its closed position to prevent light from passing between said flange and said adjacent slat.

2. The structure of claim 1 wherein the vertical side of said housing adjacent the ends of said slats includes a surface contour adapted to matingly cooperate with the contour of the ends of said adjacent slats to eliminate lines of sight and light between said housing and slats when the blind is in a closed position.

3. The structure of claim 2 wherein said surface contour is further defined as being V-shaped, said V-shaped contour has a vertex and said slats have horizontal axes of rotation for positioning said slats in a vertical plane which includes the vertex of said V-shaped contour surface.

4. A window and window blind comprising:

a window frame having front and rear sides, top and bottom and opposite side frame portions forming a plurality of corners in a plane, an operator having a housing positioned in the plane of and in a corner of said frame, said housing havving front and back sides, top and bottom ends, and opposite vertical sides, one of said opposite vertical sides of said housing comprising groove means, a slatted blind in said frame having slats adjustable between open and closed positions, and a mounting bracket fastened in said corner of said frame removably connecting said housing to said window frame, said bracket having a first member for supporting the bottom end of said housing and a second member for supporting one of said vertical sides of said housing, said second member having shoulder means which cooperates with said groove means on one of said vertical sides of said housing for mounting the housing to said window frame.

5. The structure of claim 4 whereins said bracket includes a stop means engaging said window frame for centering said bracket and housing relative to said frame and blind.

6. The structure of claim 5 wherein said stop means is further defined as being a vertical flange on said second member of said bracket engaging said front side of the adjacent side frame portion of said frame.

7. The structure of claim 6 wherein said first member of said bracket includes a downwardly extending flange for engagement with the front side of said window frame.

8. The structure of claim 4 wherein said shoulder means of said member and said groove menas on one of said vertical sides of said housing allows for slidably interconnecting said housing to said bracket.

9. The structure of claim 8 and further including a cap member having means for slidably engaging the top end of said housing and including an upstanding flange, said blind having a slat adjacent said upstanding flange, said flange positioned to overlap the adjacent blind slat when in a closed position to prevent light from entering between said flange and said adjacent slat.

10. The structure of claim 4 wherein said window frame and said bracket have sloped abutting surfaces for positioning said housing in the plane of said frame.

11. A window blind operator comprising:

a housing having front and back sides, top and bottom ends, and opposite vertical sides, said top end having an upstanding flange extending the substantial distance between the opposite vertical sides and being generally perpendicular thereto adapted to overlay an adjacent slat of a blind in its closed position to prevent light from passing between the top of the housing and said adjacent slat, one of said vertical sides having a surface defining a concave shaped horizontal cross section, said one side having said concave horizontal cross section having a longitudinal center vertical axis and said one vertical side being adapted to matingly register with the adjacent ends of blind slats to prevent passage of light between said one vertical side of said housing and the ends of the blind slats when the blind is in a closed position, and said upstanding flange being parallel to a vertical plane extending through said longitudinal center vertical axis of said one vertical side.

12. The structure of claim 4 wherein said concave surface is further defined as being V-shaped.

* * * * *